US005307766A

United States Patent [19]

Pearce

[11] Patent Number: 5,307,766

[45] Date of Patent: May 3, 1994

[54] TEMPERATURE CONTROL OF STEAM FOR BOILERS

[75] Inventor: Ralph P. Pearce, Lower Burrell, Pa.

[73] Assignee: Westinghouse Electric Corp., Pittsburgh, Pa.

[21] Appl. No.: 30,521

[22] Filed: Mar. 12, 1993

[51] Int. Cl.[5] ..... F22G 5/00

[52] U.S. Cl. ..... 122/479.1; 122/406.4; 122/460; 122/448.4; 122/479.7

[58] Field of Search ..... 122/479.1, 406.4, 460, 122/448.4, 479.7

[56] References Cited

U.S. PATENT DOCUMENTS

| | | | |
|---|---|---|---|
| 3,172,462 | 3/1965 | Brunner . | |
| 4,023,537 | 5/1977 | Carter, Sr. et al. . | |
| 4,031,863 | 6/1977 | Läubli . | |
| 4,241,701 | 12/1980 | Morse . | |
| 4,261,301 | 4/1981 | Lösel et al. . | |
| 4,549,503 | 10/1985 | Keyes, IV et al. . | |
| 4,637,348 | 1/1987 | Fukayama | 122/406.4 |
| 4,759,314 | 7/1988 | Banweg et al. . | |
| 4,776,301 | 10/1988 | Dziubakowski . | |
| 4,887,431 | 12/1989 | Peet . | |

*Primary Examiner*—Henry C. Yuen
*Attorney, Agent, or Firm*—Peyton C. Watkins

[57] ABSTRACT

A once-through boiler for producing steam from water comprising a boiler vessel having an interior portion, an inlet for passing the water into the boiler vessel, and an outlet. A first conduit is attached to the inlet for passing the water through said boiler vessel and is disposed in the interior of the vessel. A heater positioned within said interior portion and operable to generate heat for evaporating the water in the first conduit. A second conduit is connected to said first conduit at one end of the second conduit and to the outlet at the other end of the second conduit; wherein the second conduit passes the steam generated in the first conduit, and the heater is operable to heat the steam passing through the second conduit; wherein the second conduit attaches to the first conduit in the interior of the boiler vessel, passes externally to the vessel, and thereafter passes into the interior of the boiler vessel where the second conduit connects to the outlet. A spray valve is connected to the second conduit for controlling the temperature rise of the heater. A thermocouple for measuring the steam temperature is connected to the portion of the second conduit which is disposed externally to the vessel; wherein the thermocouple cooperates with the heater and the spray valve, and the heater generates more heat when the thermocouple senses the temperature below a desired level, and the spray valve releases water into the second conduit when the thermocouple senses the temperature above a desired level.

5 Claims, 1 Drawing Sheet

TEMPERATURE CONTROL OF STEAM FOR BOILERS

BACKGROUND OF THE INVENTION

1. Field of the Invention

The present invention relates to once-through boilers and, more particularly, is concerned with improved steam temperature control for once-through boilers.

2. Background of the Invention

In a commercial once-through boiler, heat, from which steam and, ultimately, electricity are generated, is produced by burning a fossil fuel, such as coal or oil. The boiler is connected to a steam turbine which in conjunction with a generator produces electricity. The once through boiler itself includes a vessel body. A heater is attached to an interior surface of the vessel body for heating any water or steam passing therethrough. In a simplified form, a series of contiguous components pass through the vessel and forms a continuous conduit for conveying water and, eventually, steam therethrough. The conduit extends generally from the vessel exterior into the vessel and then out of the vessel again. Once the conduit enters the vessel, the water flowing therethrough is converted to steam in a first portion of the conduit, and a latter portion (i.e., superheater) of the conduit heats the steam before it exits the vessel via an outlet. To control the temperature of the steam discharged from the vessel, the temperature of the superheater is varied. A spray valve positioned outside the vessel discharges water into the conduit to counteract the temperature rise associated with the heater, if necessary. The temperature of the superheater is controlled by cooperative interaction between the heater and the spray valve. For example, to increase the heating in the superheater, the heater temperature is increased thereby increasing the temperature rise within the superheater. To lower the temperature of the superheater, the spray valve sprays water into the superheater thereby counteracting the heat of the heater and reducing the temperature rise within the superheater.

A thermocouple is attached to the conduit at the vessel outlet (outside the vessel body), and it communicates with both the spray valve and the heater. This thermocouple measures the temperature of the steam passing therethrough. For efficiency, the steam leaving the boiler and entering the turbine should be within preset limits. The thermocouple measures the temperature to determine if the preset limits are met and communicates this information to the heater and spray valve. If the temperature is below the bottom acceptable limit, the heater generates more heat, further heating the steam in the superheater. If the temperature exceeds an acceptable upper limit, the spray valve releases water into the superheater. This action lowers the temperature rise within the superheater so that heating of the steam is reduced.

Although the presently utilized system is efficient, it is not without drawbacks. In this regard, the steam has significant travel time through the superheater. If the temperature of the steam traveling through the superheater is not within the predetermined limits, it will not be detected until it reaches the thermocouple adjacent the steam outlet. The thermocouple will communicate this information to the spray valve and heater which, after receiving this information, reacts appropriately to either raise or lower the temperature of the steam within the superheater. This is a drawback because a time delay exists before efficient steam is passed to the turbine.

Consequently, a need exists for an improved temperature control of steam developed by once-through boilers.

SUMMARY OF THE INVENTION

The present invention provides an improvement designed to satisfy the aforementioned need. Particularly, the present invention is directed to a once through boiler for producing steam from a liquid comprising: a) a boiler vessel having an interior portion, an inlet for introducing the liquid into said boiler vessel, and an outlet; b) a first conduit attached to the inlet for passing the liquid through said boiler vessel and disposed in the interior of the vessel; c) a heater positioned within said interior portion and operable to generate heat for evaporating the water in said first conduit; d) a second conduit attached to said first conduit at one end and to the outlet at the other end; wherein said second conduit passes the steam generated in said first conduit therethrough, and the heater heats the steam passing through said second conduit; wherein said second conduit attaches to said first conduit in the interior of said boiler vessel, passes externally to said boiler vessel, and thereafter passes into the interior of said boiler vessel where said second conduit connects to the outlet which passes the team out of said boiler vessel; f) a spray valve connected to said second conduit for controlling the temperature rise of the heater; and g) a first thermocouple for measuring the steam temperature connected to the portion of said second conduit disposed externally to the vessel; wherein said first thermocouple cooperates with said heater and said spray valve, and said heater generates more heat when said first thermocouple senses the temperature below a desired level, and said spray valve releases water into said second conduit when said first thermocouple senses the temperature above a desired level.

These and other features and features of the present invention will become apparent to those skilled in the art upon a reading of the following detailed description when taken in conjunction with the drawings wherein is shown and described an illustrative embodiment of the invention.

BRIEF DESCRIPTION OF THE DRAWINGS

While this specification concludes with claims particularly pointing out and distinctly claiming the subject matter of the invention, it is believed the invention will be better understood from the following description, taken in conjunction with the accompanying drawings wherein:

DESCRIPTION OF THE PREFERRED EMBODIMENT

Figure 1:
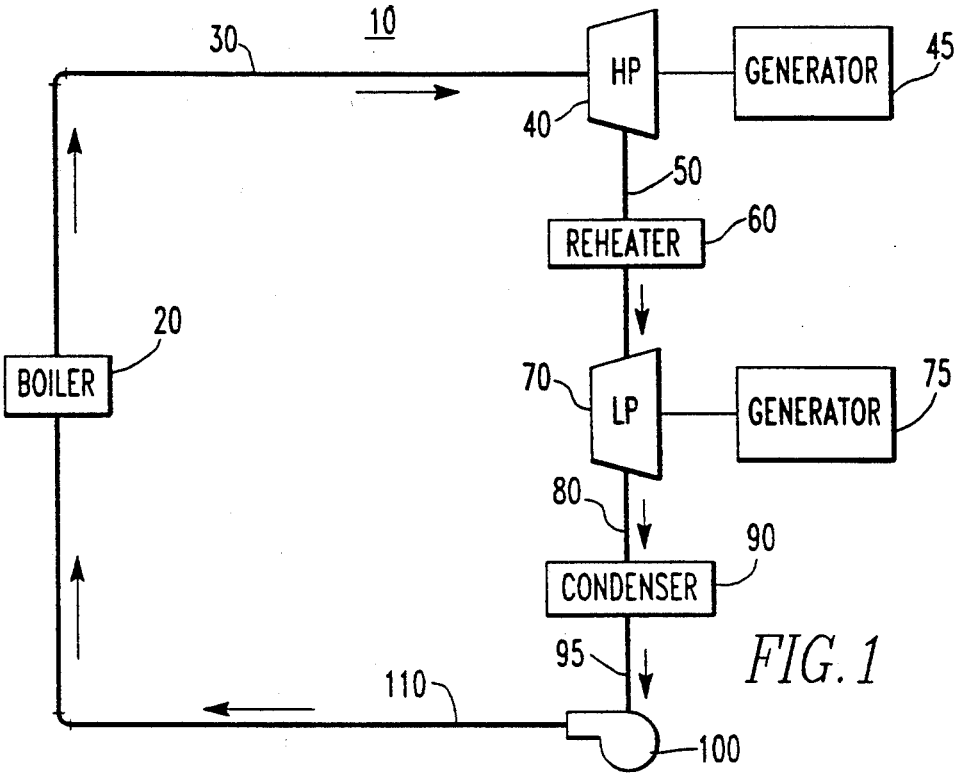
FIG. 1 is a schematic diagram of a portion of a fossil fuel power plant.

Referring now to the drawings wherein like reference numerals refer to like elements, FIG. 1 illustrates the environment of the present invention and depicts a portion of a fossil fuel power plant, generally referred to as 10. The power plant converts thermal energy into mechanical energy for use in producing electricity. In this regard, water (not shown) enters a boiler 20 wherein heat is produced, and this heat converts the water into steam. The steam exits the boiler 20 via an outlet pipe 30 and flows into a high pressure turbine 40. The steam turns turbine blades secured to a shaft (not shown) inside the turbine 40, and a generator 45 connected to the turbine 40 is operable to produce electricity in a well known manner as this turbine shaft rotates. The steam leaves the turbine 40 via a pipe 50 and enters a reheater 60 wherein the steam is reheated. The reheated steam enters a low pressure turbine 70 and turns turbine blades secured to a shaft (not shown) inside the turbine 70. A second generator 75 connected to the low pressure turbine 70 is operable to produce electricity in a well known manner as this turbine shaft rotates. The steam exits the low pressure turbine 70 via a pipe 80 and enters a condenser 90 where the steam is condensed back to water. The water exits the condenser 90 via a pipe 95 and flows into a pump 100 which pumps the water back to the boiler 20 via an inlet pipe 110.

Figure 2:
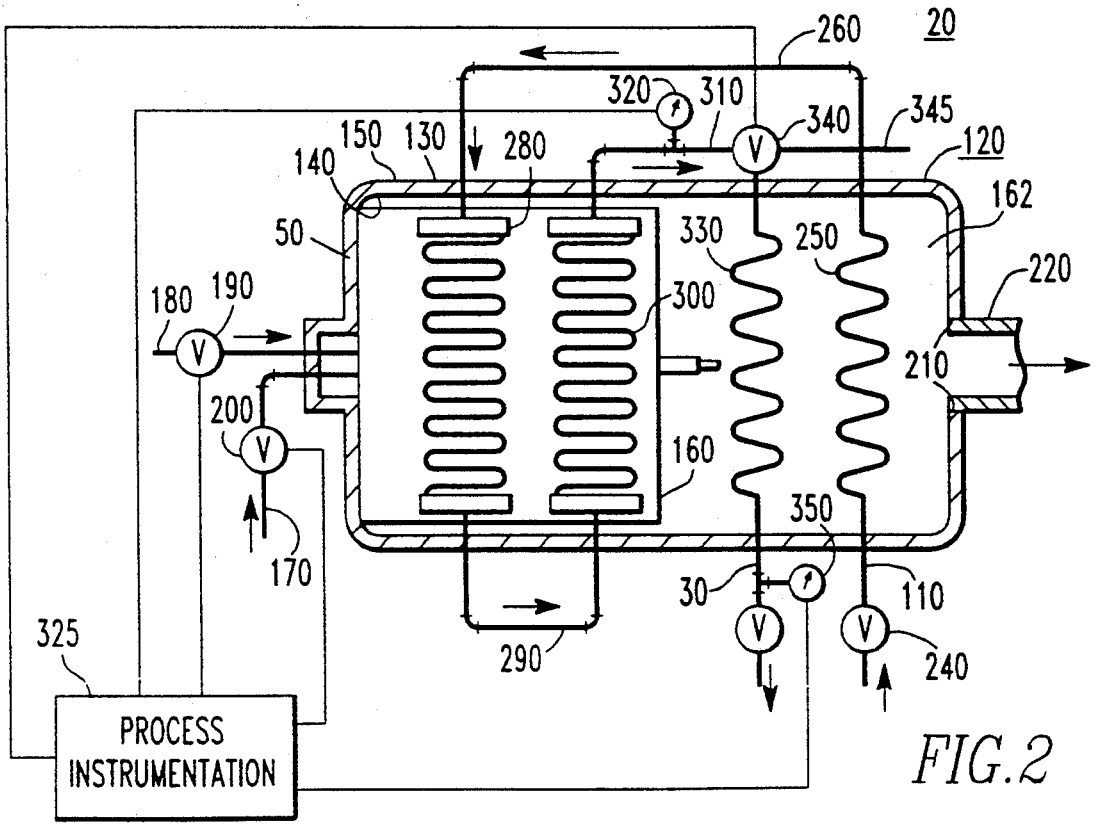
FIG. 2 is a schematic diagram of an improved once-through boiler illustrating the improved temperature control scheme of the present invention.

Referring to FIG. 2, the boiler 20 is shown and includes a vessel body 120. The vessel body 120 includes an outside wall 130 and an inside wall 140 defining a wall thickness 150. A heater 160 is attached to the inside wall 140 and produces a fire within the interior 162 of the vessel body 120 by burning fossil fuels, such as coal or oil. To produce this heating, air enters the heater 160 via a pipe 170 which extends through the wall thickness 150 of the vessel body 120 to the heater 160, and the fuel (i.e., coal or oil) enters the heater 160 via a pipe 180 which, likewise, extends through the wall thickness 150 of the vessel body 120. The air and fuel entering the heater 160 cooperate with each other to control the heat generated by the heater 160. A valve 190 is positioned on the fuel pipe 180 for controlling the amount of fuel entering the heater 160, and a valve 200 is, likewise, positioned on the air pipe 170 for controlling the amount of air entering the heater 160. An opening 210 in the vessel body 120 is positioned at the opposite side of the vessel body 120 from the heater 160 for receiving a pipe 220 which allows the heated gas (i.e., air) inside the vessel body 120 to escape.

In order to heat water within the boiler 20 and ultimately produce steam, water enters the vessel body 120 via the inlet pipe 110. A valve 240 is disposed on the inlet pipe 110 for controlling the quantity of water entering the vessel 120. The inlet pipe 110 extends through the wall thickness 150 and into the interior 162 of the vessel body 120 where it is connected to an economizer 250. The economizer 250 is a looping shaped pipe and is the first stage for heating the water entering the vessel 120. The economizer 250 extends through the interior 162 of the vessel body 120 and exits the vessel body 120 through the wall thickness 150 opposite the feedwater inlet 230. Adjacent to the outside wall 130, a pipe 260 is attached to the economizer 250, and the pipe 260 extends along the outside of the vessel body 120 as shown. The pipe 260 enters the vessel 120 through the wall thickness 150 and is attached to the first stage of an evaporating section 280. Thus, water flowing through the economizer 250 continues through the pipe 260 to enter the evaporating section 280. The evaporating section 280 is a looping shaped pipe and is the primary component for evaporating the water passing therethrough. The evaporating section 280 passes through the heater 160 which evaporates a portion of the water, and the evaporating section 280 extends generally over the height of the vessel 120. The heated gas within the interior 162 of the vessel body 120 flows over the evaporating section 280 elevating the temperature of the water therein to convert the water to steam.

A pipe 290 for conveying the steam and water generated or passed through the evaporating section is connected to the discharge end of the evaporating section 280. The pipe 290 passes through the wall thickness 150 and extends along the outside wall 130. The pipe 290 reenters the vessel 120 through the wall thickness 150 and is attached to an evaporating section 300. The evaporating section 300 continues to evaporate any water passing therethrough and further heats the steam carried by the water. The evaporating section 300 passes through the heater 160. The evaporating section 300 is attached to a pipe 310. The pipe 310 passes through the wall thickness 150 and extends along the outside surface of the vessel body 120. The pipe 310 re-enters the vessel body 120 through the wall thickness 150. A thermocouple 320, such as a type E constant, is connected with the pipe 310 in a well known manner and at a location where the pipe 310 is positioned outside of the vessel body 120. This thermocouple 320 measures the temperature of the steam passing through the pipe 310.

As previously described, for the system described with respect to FIG. 1 to be efficient, steam passing into the high pressure turbine 40 (not shown in FIG. 2) should be between predetermined temperature limits. The thermocouple 320 measures the steam temperature and passes this information to process instrumentation 325 which determines how much the steam should be heated in the next section (i.e., a superheater 330) so that the steam falls within these preset temperature limits. The superheater 330 is positioned within the interior 162 of the vessel body 120 and is attached to the pipe 310. The superheater 330 functions to heat the steam passing therethrough. The heat from the heater 160 heats the superheater 330. A spray valve 340 is positioned outside the vessel 120 and, if necessary, sprays water into the superheater 330 to counteract the heat of the heater 160, mitigating the heat rise of the steam in the superheater 330 due to the heater 160. The spray valve 340 introduces water into the superheater 330 via a pipe 345. The outlet pipe 30 is attached to the superheater 330 adjacent the inside wall 140 and extends through the wall 150 allowing the steam to pass to the high pressure turbine 40 (see FIG. 1). A thermocouple 350 is attached to the outlet pipe 30 for measuring the temperature of the steam passing therethrough. This thermocouple 350 is the final steam temperature measuring device before the steam enters the high pressure turbine 40 (see FIG. 1). The thermocouple 350 communicates the temperature to the process instrumentation 325 which, in turn, coordinates the two temperatures received from the thermocouples 350 and 320. In receiving two temperature readouts (in lieu of only one from the thermocouple 350) from different locations, the process instrumentation 325 is able to efficiently regulate the heater 160 and spray valve 340 for controlling the temperature rise in the superheater 330.

It is thought that the present invention and the many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A once-through boiler for producing steam from a liquid comprising:

a) a boiler vessel having an interior portion, an inlet for introducing the liquid into said boiler vessel, and an outlet;

b) a first conduit attached to the inlet for passing the liquid through said boiler vessel and disposed in the interior of the vessel;

c) a heater positioned within said interior portion and operable to generate heat for evaporating the liquid in said first conduit;

d) a second conduit attached to said first conduit at one end of said second conduit and to the outlet at the other end of said second conduit; wherein said second conduit passes the steam generated in said first conduit, and said heater operable to heat the steam passing through said second conduit; wherein said second conduit attaches to said first conduit in the interior of said boiler vessel, passes externally to said boiler vessel, and thereafter passes into the interior of said boiler vessel where said second conduit connects to the outlet which passes the steam out of said boiler vessel;

f) a spray valve connected to said second conduit for controlling the temperature rise of the heater; and g) a first thermocouple for measuring the steam temperature connected to the portion of said second conduit disposed externally to said boiler vessel; wherein said first thermocouple cooperates with said heater, and said heater generates more heat when said first thermocouple senses the temperature below a desired level, and said heater decreases its heat when said heater senses the temperature above a desired level.

2. The device as recited in claim 1 wherein said first conduit includes an evaporating section passing through said heater.

3. The device as recited is claim 2 wherein said second conduit includes a superheater disposed inside the vessel and a pipe disposed externally to the vessel, and the pipe is disposed between the evaporating section and the superheater.

4. The device as recited in claim 3 wherein said thermocouple is disposed on the pipe.

5. The device as recited in claim 4 further comprising a second thermocouple disposed on the outlet and communicating with said spray valve for efficiently coordinating regulation of the temperature rise in the superheater.

* * * * *